US005560340A

United States Patent [19]

Tomisawa

[11] Patent Number: 5,560,340

[45] Date of Patent: Oct. 1, 1996

[54] FUEL-SUPPLY SYSTEM FOR INTERNAL COMBUSTION ENGINES

[75] Inventor: Naoki Tomisawa, Atsugi, Japan

[73] Assignee: Unisia Jecs Corporation, Atsugi, Japan

[21] Appl. No.: 529,464

[22] Filed: Sep. 18, 1995

[30] Foreign Application Priority Data

Sep. 19, 1994 [JP] Japan ..... 6-223736

[51] Int. Cl.[6] ..... F02M 51/00

[52] U.S. Cl. ..... 123/494

[58] Field of Search ..... 123/478, 494, 123/497, 516

[56] References Cited

U.S. PATENT DOCUMENTS

| | | | |
|---|---|---|---|
| 4,336,782 | 6/1982 | Endo et al. | 123/494 |
| 4,513,728 | 4/1985 | Ullman et al. | 123/478 |
| 5,150,690 | 9/1992 | Carter et al. | 123/478 |
| 5,218,941 | 6/1993 | Suzuki et al. | 123/494 |
| 5,377,645 | 1/1995 | Moore | 123/478 |
| 5,379,740 | 1/1995 | Moore et al. | 123/478 |
| 5,462,031 | 10/1995 | Kai | 123/478 |
| 5,463,998 | 11/1995 | Denz et al. | 123/520 |

*Primary Examiner*—Thomas N. Moulis
*Attorney, Agent, or Firm*—Foley & Lardner

[57] ABSTRACT

An electronically controlled fuel-supply system for an internal combustion engine, comprises a fuel tank, a fuel pump mounted in the fuel tank, a fuel-injection valve delivering fuel of a fuel-supply amount, based on its valve opening time period, to an engine cylinder, a pressure regulator mounted in the fuel tank and responsive to a first pressure difference between a fuel pressure of fuel pumped and a reference pressure, for regulating the first pressure difference at a predetermined value, an internal-pressure sensor for detecting an internal pressure in the fuel tank, and a boost-pressure sensor for detecting a boost pressure acting on an open end of a nozzle of the fuel-injection valve. The pressure regulator uses the internal pressure as the reference pressure. A control unit is provided for correcting the valve opening time period in accordance with a second pressure difference between the internal pressure and the boost pressure.

7 Claims, 3 Drawing Sheets

FUEL-SUPPLY SYSTEM FOR INTERNAL COMBUSTION ENGINES

BACKGROUND OF THE INVENTION

1. Field of the Invention

The present invention relates to an electronically controlled fuel-supply system for internal combustion engines, and specifically to a system accommodating a pressure regulator in a fuel tank, which regulator is provided for properly regulating a fuel pressure of fuel delivered to each fuel-injection valve assembly.

2. Description of the Prior Art

As is generally known, in conventional electronically-controlled fuel-injection systems, a fuel pressure of fuel delivered to an electromagnetically-operated fuel-injection valve assembly is regulated by a pressure regulator, so that a fuel-injection amount per unit hour with respect to the respective fuel-injection valve assembly is held essentially constant. In general, a fuel-supply amount (a fuel-injection amount) delivered to the engine cylinder would be adjusted by varying a pulse-width (a controlled valve-opening time interval) of a fuel-injection pulse signal output to each fuel-injection valve assembly. The pressure regulator is generally provided in the vicinity of the associated fuel-injection valve assembly of the engine, to properly adjust an amount of fuel returning from the fuel-injection valve assembly via a fuel return passage into a fuel tank, and consequently to maintain the pressure difference between a fuel pressure of fuel to be injected from the fuel-injection nozzle of the fuel-injection valve assembly and a pressure (corresponding to an intake manifold pressure or a boost pressure) acting onto the open end of the nozzle valve of the fuel-injection nozzle at a predetermined constant value. In the case that the pressure regulator is provided in the vicinity of the engine cylinder block or the engine cylinder head, fuel which is returned into the fuel tank through a fuel-return passage for the purpose of fuel-pressure regulation, tends to absorb heat produced by the engine, and as a result temperatures in the fuel tank necessarily tend to rise undesirably. Additionally, the conventional system requires a very long fuel-return passage intercommunicating the pressure regulator and the fuel tank. To avoid this, there has proposed and developed a fuel-supply system equipped with a pressure regulator accommodated in a fuel tank. In such a system, fuel returned from the pressure regulator via the return passage to the fuel tank cannot be influenced by heat produced by the engine, and thus a temperature-rise in the fuel tank may be suppressed to a minimum. However, in the same manner as the former system employing a pressure regulator in the vicinity of the engine, in case of the latter system employing a pressure regulator in a fuel tank, an intake manifold pressure (a boost pressure) acting onto the open end of the nozzle valve of the fuel-injection nozzle, which pressure serves as a reference pilot pressure for the regulator, must be introduced into the inlet port of the regulator for the purpose of regulating-action of the fuel pressure toward a desired pressure level. As can be appreciated, the latter system suffers from the drawback that a length of a boost-pressure conduit required for extracting or introducing the boost pressure in the intake manifold to the inlet of the pressure regulator accommodated in the fuel tank is extremely long.

SUMMARY OF THE INVENTION

Accordingly, it is an object of the invention to provide an improved electronically controlled fuel-supply system which avoids the foregoing disadvantages of the prior art.

It is another object of the invention to provide an improved electronically controlled fuel-supply system which is capable of ensuring a desired fuel-supply amount (a desired fuel-injection amount), while providing a minimum fuel-supply/pilot-pressure conduit structure necessary for interconnection between a pressure regulator and a fuel tank and between the regulator and a fuel-injection valve assembly, and necessary for provision of information of a reference pressure applied to the regulator.

It is a further object of the invention to provide an improved electronically controlled fuel-supply system which is capable of minimizing a space for installation of a plurality of conduits required for an electronically controlled fuel-supply action, and of reducing total manufacturing costs of the system.

In order to accomplish the aforementioned and other objects of the invention, an electronically controlled fuel-supply system for an internal combustion engine, comprises a fuel tank, a fuel pump mounted in the fuel tank, a fuel-injection valve delivering fuel of a fuel-supply amount, which amount is based on its valve opening time period, to an engine cylinder, a pressure regulator mounted in the fuel tank and responsive to a first pressure difference between a fuel pressure of fuel pumped by the fuel pump and a reference pressure, for regulating the first pressure difference at a predetermined value by opening and closing a fuel return line connected to the pressure regulator, and for delivering fuel of a fuel pressure regulated by the pressure regulator to the fuel-injection valve, a first sensor for detecting an internal pressure in the fuel tank, a second sensor for detecting a pressure acting on an open end of a nozzle of the fuel-injection valve, the pressure regulator receiving the internal pressure as the reference pressure, and correction means for correcting the valve opening time period in accordance with a second pressure difference between the internal pressure in the fuel tank and the pressure acting on the open end of the nozzle.

According to another aspect of the invention, an electronically controlled fuel-supply system for an internal combustion engine, comprises a sealed fuel tank, a fuel pump mounted in the sealed fuel tank, a fuel-injection valve delivering fuel of a fuel-supply amount, which amount is based on its valve opening time period, to an engine cylinder, a pressure regulator mounted in the fuel tank and responsive to a first pressure difference between a fuel pressure of fuel pumped by the fuel pump and a reference pressure, for regulating the first pressure difference at a predetermined value by opening and closing a fuel return line, and for delivering fuel of a fuel pressure regulated by the pressure regulator to the fuel-injection valve, a first sensor for detecting an internal pressure in the sealed fuel tank, a second sensor for detecting an intake manifold pressure acting on an open end of a nozzle of the fuel-injection valve, the pressure regulator having a regulated fuel-pressure chamber fluidly connected to both the fuel-injection valve and the fuel return line for regulating pressurized fuel pumped from the fuel pump by returning the pressurized fuel to the sealed fuel tank when the first pressure difference is above a predetermined value, and a reference pressure chamber receiving the internal pressure in the sealed fuel tank as the reference pressure, and correction means for correcting the valve opening time period in accordance with a second pressure difference between the internal pressure in the fuel tank and the intake manifold pressure acting on the open end of the nozzle. A flow rate of fuel injected from the nozzle of the fuel-injection valve is essentially proportional to a square root of a third pressure difference between the fuel pressure regulated by the pressure regulator and the intake manifold pressure acting on the open end of the nozzle. The correction means determines a square root of the second pressure difference as a correction factor for the valve opening time period. It is preferable that an extraction port of the internal pressure in the sealed fuel tank is common to the reference pressure chamber of the pressure regulator and the first sensor. Usually, the second sensor comprises a boost pressure sensor measuring the intake manifold pressure. Alternatively, the second sensor may comprise means for estimating the intake manifold pressure as a function of an engine load.

According to a further aspect of the invention, an electronically controlled fuel,supply system for an internal combustion engine, comprises a sealed fuel tank, a fuel pump mounted in the sealed fuel tank, a fuel-injection valve delivering fuel of a fuel-supply amount, which amount is based on a final pulse width of a fuel-injection pulse signal output to the fuel injection valve, to an engine cylinder, a pressure regulator mounted in the sealed fuel tank and responsive to a first pressure difference between a fuel pressure of fuel pumped by the fuel pump and a reference pressure, for regulating the first pressure difference at a predetermined value by opening and closing a fuel return line, and for delivering fuel of a fuel pressure regulated by the pressure regulator to the fuel-injection valve, a first sensor for detecting an internal pressure in the sealed fuel tank, a second sensor for detecting an intake manifold pressure acting on an open end of a nozzle of the fuel-injection valve, a third sensor for detecting an intake air flow rate of the engine, a fourth sensor for detecting an engine revolution speed, the pressure regulator having a regulated fuel-pressure chamber fluidly connected to both the fuel-injection valve and the fuel return line for regulating pressurized fuel pumped from the fuel pump by returning the pressurized fuel to the sealed fuel tank when the first pressure difference is above a predetermined value, and a reference pressure chamber receiving the internal pressure in the sealed fuel tank as the reference pressure, derivation means for deriving a target pulse width of the fuel-injection pulse signal to be output to the fuel-injection valve, as a function of at least the intake air flow rate from the third sensor and the engine revolution speed from the fourth sensor, and correction means for correcting the target pulse width of the fuel-injection pulse signal in accordance with a second pressure difference between the internal pressure in the sealed fuel tank and the intake manifold pressure acting on the open end of the nozzle. The correction means includes (a) means for reading the internal pressure from the first sensor and the intake manifold pressure from the second sensor, (b) means for determining a square root of the second pressure difference as a correction factor for the target pulse width, (c) means for deriving the final pulse width from an expression of $Tis \leftarrow K_T \times (Ti/\Delta P)$, where Tis denotes the final pulse width, $K_T$ denotes a constant, Ti denotes the target pulse width, and $\Delta P$ denotes the correction factor obtained by the square root of the second pressure difference, and (d) means for generating the final pulse width to the fuel-injection valve.

DESCRIPTION OF THE PREFERRED EMBODIMENTS

Figure 2:
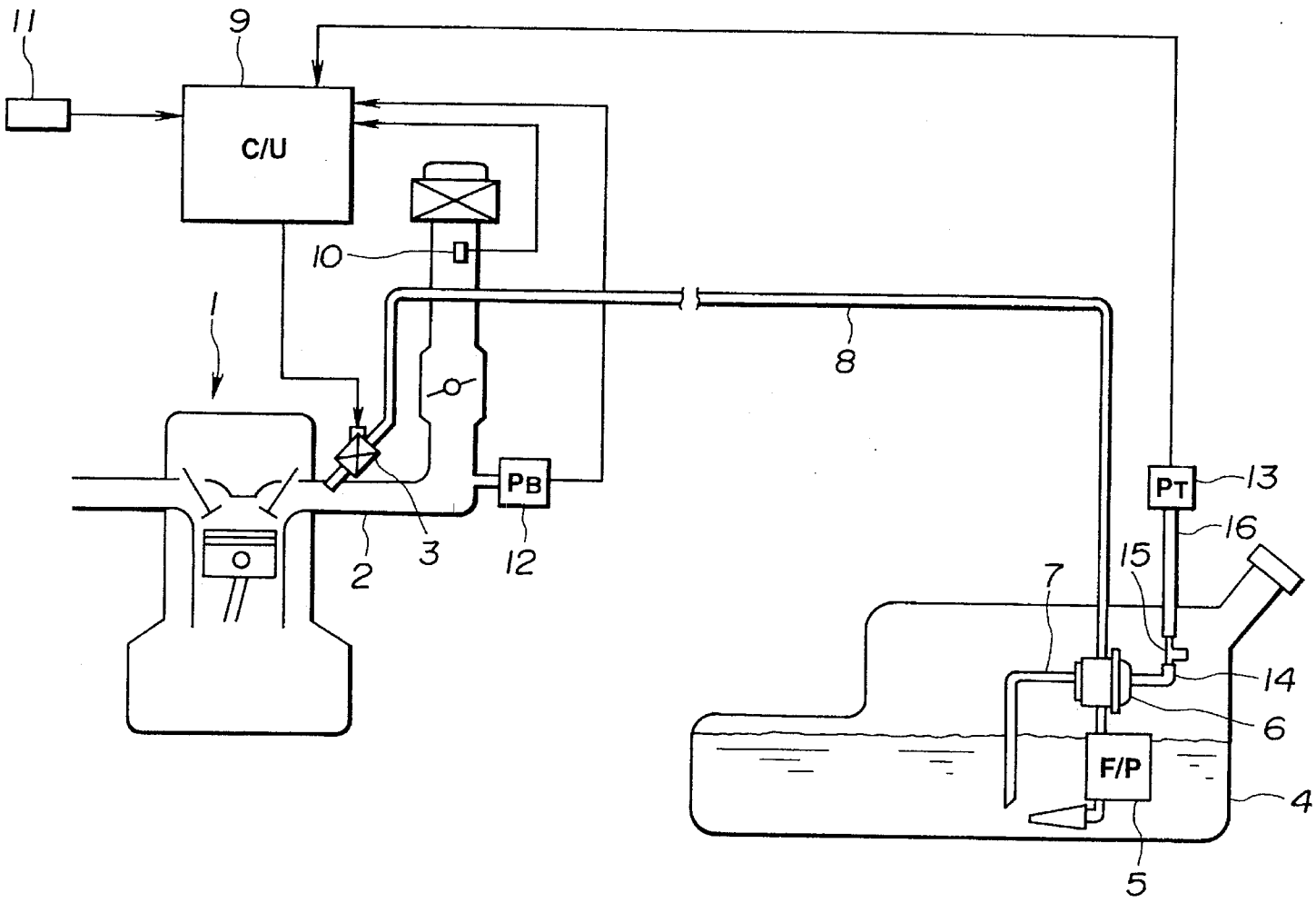
FIG. 2 is a schematic system diagram illustrating one embodiment of an electronically controlled fuel-supply system according to the invention.

Referring now to the drawings, particularly to FIG. 2, fuel-injection valve assemblies 3 are provided in respective branch pipes of an intake manifold 2 of an internal combustion engine 1. Each fuel-injection valve assembly 3 is comprised of an electromagnetically-operated fuel-injection valve unit which is generally constructed by a fuel-injection nozzle valve, a nozzle valve spring acting to bias the nozzle valve to its valve-closed position, an electromagnetic coil acting to attract the nozzle valve to its valve-opening position by way of attraction force produced by energizing the coil, and a valve housing operably accommodating therein the nozzle valve, the valve spring, and the coil. A fuel pump 5 and a pressure regulator 6 are both accommodated or mounted in a fuel tank 4. In the shown embodiment, the fuel tank 4 is comprised of a usual sealed fuel tank. As seen in FIG. 2, since the fuel pump 5 consists of an ordinal tank-mounted fuel pump, a connection line interconnecting the inlet port of the pressure regulator 6 and the discharge port of the fuel pump 5 can be dimensioned at a minimum length. Pressurized fuel discharged from the fuel pump 5 is firstly delivered to the pressure regulator 6, and then regulated at a desired fuel pressure by means of the pressure regulator 6. The fuel of the regulated fuel pressure is supplied through a fuel-supply line 8 to the inlet port of the fuel-injection valve assembly 3. Note that the pressure regulator 6 applied to the system of the invention is responsive to the pressure difference between the regulated fuel pressure and an internal pressure $P_T$ in the fuel tank 4, but not to the pressure difference between the regulated fuel pressure and a boost pressure $P_B$ (an intake manifold pressure). Although it is not clearly shown, the pressure regulator 6 of the embodiment has a regulated fuel-pressure chamber and a reference pilot-pressure chamber, both being in spaced relationship with each other by means of a diaphragm. The reference pilot-pressure chamber is communicated with an internal space of the fuel tank 4 through a short-length conduit 14, so as to receive the internal pressure in the fuel tank 4. On the other hand, the regulated fuel-pressure chamber is communicated with the inlet port of the fuel-injection valve assembly 3 via the fuel-supply line 8, and also communicated with the fuel-return line 7 only when the pressure difference between the regulated fuel pressure and the tank internal-pressure $P_T$ exceeds a predetermined threshold value. With the above-noted arrangement of the regulator 6, when the pressure difference between the tank internal-pressure $P_T$ and the regulated fuel pressure produced by the regulator 6 exceeds the predetermined threshold value, some of fuel just discharged from the fuel tank 4 can be quickly returned from the fuel-pressure chamber of the regulator 6 to the tank 4 via a very short fuel-return line 7. The fuel just discharged from the fuel tank 4 cannot be influenced by heat produced by the engine 1. This prevents an undesired temperature-rise in the fuel tank 4 owing to fuel returned from the pressure regulator 6. Additionally, the pressure regulator 6 of the system made according to the invention uses the tank internal-pressure $P_T$ as its reference pilot pressure and thus requires a very short conduit necessary to introduce the reference pilot pressure thereinto, whereas hitherto a comparatively long conduit was necessary to introduce a boost pressure (an intake manifold pressure) serving as a reference pilot pressure for a pressure regulator.

A period of time of activation of the electromagnetic coil of the fuel-injection valve assembly 3 is controlled by a fuel-injection pulse signal produced by a control unit 9. As is well-known, a fuel-supply amount to be supplied to each individual branch pipe of the intake manifold is adjusted depending on a pulse width (corresponding to the controlled nozzle-valve-opening time interval) of the fuel-injection pulse signal.

The control unit 9 with a built-in microcomputer derives a basic injection pulse width Tp as a function of an intake air flow rate Q detected by and generated from an air-flow meter 10 and an engine revolution speed Ne based on a rotational speed indicative signal generated from a crank angle sensor 11, as follows.

$$Tp \leftarrow K \times Q/Ne$$

where K is a constant.

The control unit 9 functions to set an effective injection pulse width Te by suitably correcting the basic injection pulse width Tp with various correction factors, such as an engine-coolant-temperature depending correction coefficient based on an engine coolant temperature Tw. The control unit 9 also operates to add a correction pulse width Ts to the effective injection pulse width Te, in consideration of a delay time of injection-timing of the fuel-injection valve assembly 3, so as to determine a target pulse width Ti ($\leftarrow$Te+Ts) of the fuel-injection pulse signal to be supplied to the fuel-injection valve assembly 3. As seen in FIG. 2, the input interface of the control unit 9 is also connected to a boost pressure sensor 12 to receive the boost pressure PB and to a tank internal-pressure sensor 13 to receive the tank internal-pressure PT. The control unit 9 executes a procedure for correction of the target pulse width Ti, as explained later.

Usually, the fuel-injection valve assembly 3 is designed so that a flow rate of fuel injected from the injection-nozzle valve fully opened is essentially proportional to a square root of the pressure difference between the fuel pressure and the boost pressure PB. Owing to the usual valve structure of the fuel-injection valve assembly 3, in order to provide a desired fuel-injection amount (a desired fuel-supply amount), the above-noted target injection pulse width Ti is traditionally determined under a particular condition in which the pressure difference between the fuel pressure of fuel delivered to the injection nozzle of the fuel-injection valve assembly 3 and the boost pressure PB (an intake manifold pressure) is held at a predetermined constant value and thus a fuel-injection amount per unit valve-opening time duration is held constant. In other words, in case that the above-noted particular condition is not satisfied, that is, when the pressure difference between the fuel pressure and the boost pressure is not held constant, the fuel-injection amount per unit hour will fluctuate. In such a case, due to fluctuations in the pressure difference, an actual fuel-injection amount for each individual cylinder cannot be varied in proportion to the target pulse width Ti of the fuel-injection pulse signal. In the electronically controlled fuel-supply system of the present embodiment, the usual fuel-injection valve assembly is used, and additionally the pressure regulator 6 applied to the system made according to the present invention functions to maintain a predetermined constant pressure difference between the fuel pressure and the internal-pressure PT of the fuel tank, but not a predetermined constant pressure difference between the fuel pressure and the boost pressure PB. As appreciated, if the fuel-injection pulse signal of the target pulse width Ti, which pulse width is effective under the above-noted particular condition, is output to the fuel-injection valve assembly 3, a desired fuel-injection amount cannot be achieved, with the result that an air-fuel-mixture ratio will not be adjusted to a stoichiometric air-fuel ratio (a target air-fuel ratio).

For the reasons set out above, it is necessary to properly correct the target pulse width Ti.

Figure 3:
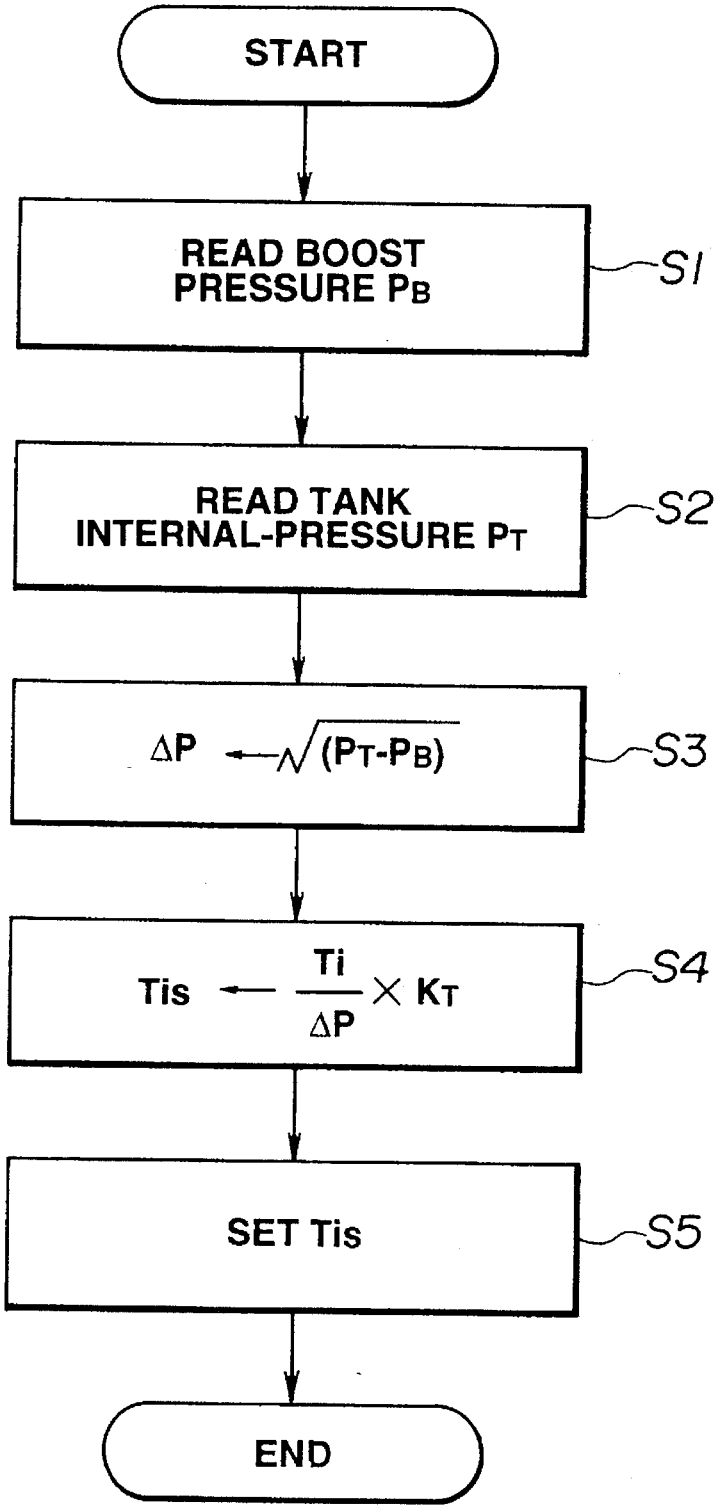
FIG. 3 is a flow chart illustrating a control routine for correction of a pulse-width of a fuel-injection pulse signal, executed by the system of the present invention.

Referring now to FIG. 3, there is shown a procedure for correction of the target pulse width Ti. The correction procedure is executed by the control unit 9 in accordance with the flow chart indicated in FIG. 3, as follows.

In step S1, the boost pressure PB detected by the boost-pressure sensor 12 is read. As seen in FIG. 2, the boost-pressure sensor 12 is provided in the vicinity of the intake manifold 2 for accurately detecting a boost pressure PB (an intake manifold pressure). Instead of a boost pressure actually measured or detected by the boost-pressure sensor 12, a properly estimated boost pressure may be used. For example, the boost pressure may be estimated as a function of the previously-noted basic injection pulse width Tp which is essentially correlated with an engine load. In other words, the boost pressure PB may be estimated on the basis of the engine load. In this case, it is unnecessary to install a boost-pressure sensor 12 on the automotive vehicle.

In step S2, the internal-pressure PT detected by the tank internal-pressure sensor 13 is read. As clearly seen in FIG. 2, the internal pressure PT is extracted into the tank internal-pressure sensor 13 through a relatively short extraction conduit 16. The extraction port of the extraction conduit 16 is connected to a first port of a T-shaped three-way connector 15. A second port of the connector 15 is connected to one end of the short-length conduit 14 which is connected to the reference pilot-pressure chamber of the pressure regulator 6 at its another end. A third port of the connector 15 is exposed to the internal space of the fuel tank 4, to provide a common internal-pressure introduction port for both the reference pilot-pressure chamber of the pressure regulator 6 and the tank internal-pressure sensor 13. The above-noted tank internal-pressure line structure ensures a precise detection for the tank internal pressure PT serving as the reference pilot pressure of the pressure regulator 6. In modern automobiles with a fuel-vapor recovery system in which a fuel-tank vent pipe is connected to a carbon canister for trapping the fuel vapor and for preventing the free escape vaporized fuel into the atmosphere, the tank internal-pressure PT is usually utilized for a diagnosis or check for leakage of fuel vapors from the fuel system (the evaporator). To check for fuel vapor leakage, an internal-pressure sensor is ordinarily mounted for detecting the fuel-vapor leakage. It will be appreciated that such a tank internal-pressure sensor for the diagnosis for the fuel-vapor leakage may be applied to an internal-pressure sensor required for the fuel-injection control executed by the system made according to the invention.

In step S3, a square root $(P_T-P_B)^{1/2}$ of the pressure difference (PT–PB) between the tank internal-pressure PT and the boost pressure PB is set at a correction factor ΔP for the pulse width Ti of the fuel-injection pulse signal to be output to the fuel-injection valve assembly 3. As previously described, during activation of the fuel-injection valve assembly, the flow rate of fuel injected from the nozzle valve is substantially proportion to the square root of the pressure difference between the fuel pressure and the boost pressure (the intake manifold pressure). As previously explained, in the present embodiment, the tank internal-pressure $P_T$ is used as a reference pilot pressure for the fuel-pressure regulating action of the pressure regulator 6. This produces an error of fuel-pressure regulation, owing to the deviation ($P_T$–$P_B$) between the tank internal-pressure $P_T$ and the boost pressure $P_B$. The error of the fuel-pressure regulation results in the error of the flow rate of fuel injected from the nozzle valve. The error of the flow rate of fuel injected is represented as a value proportional to a square root $(P_T-P_B)^{1/2}$ of the deviation ($P_T$–$P_B$). Assuming that the injection pulse signal of the pulse width Ti containing the erroneously regulated fuel-pressure component is generated, an undesirably increased amount of the fuel will be injected into each individual cylinder.

Thus, in step S4, for the purpose of ensuring a desired amount of fuel injected from the nozzle valve of the fuel-injection valve assembly 3, the pulse width Ti is decreasingly corrected on the basis of the following expression.

$$Tis \leftarrow K_T \times Ti/\Delta P$$

where Tis denotes a corrected injection pulse width, and $K_T$ is a constant.

In step S5, the corrected injection pulse width Tis is set in a register, such that the fuel-injection pulse signal of the corrected pulse width Tis is output to the fuel-injection valve assembly 3 whose injection timing is just reached. In this manner, a desired fuel-supply amount to each individual cylinder can be achieved by utilizing the properly corrected injection pulse width Tis.

Returning to FIG. 2, according to the line structure containing both the fuel line and the reference pressure line, all lines other than the fuel-supply line 8 can be dimensioned to a minimum length. The pressure regulator 6 and the fuel pump 5 are arranged close to each other, and additionally the pressure regulator 6 and the internal-pressure sensor 13 are arranged close to each other, and thus the line structure is considerably simple.

Figure 1:
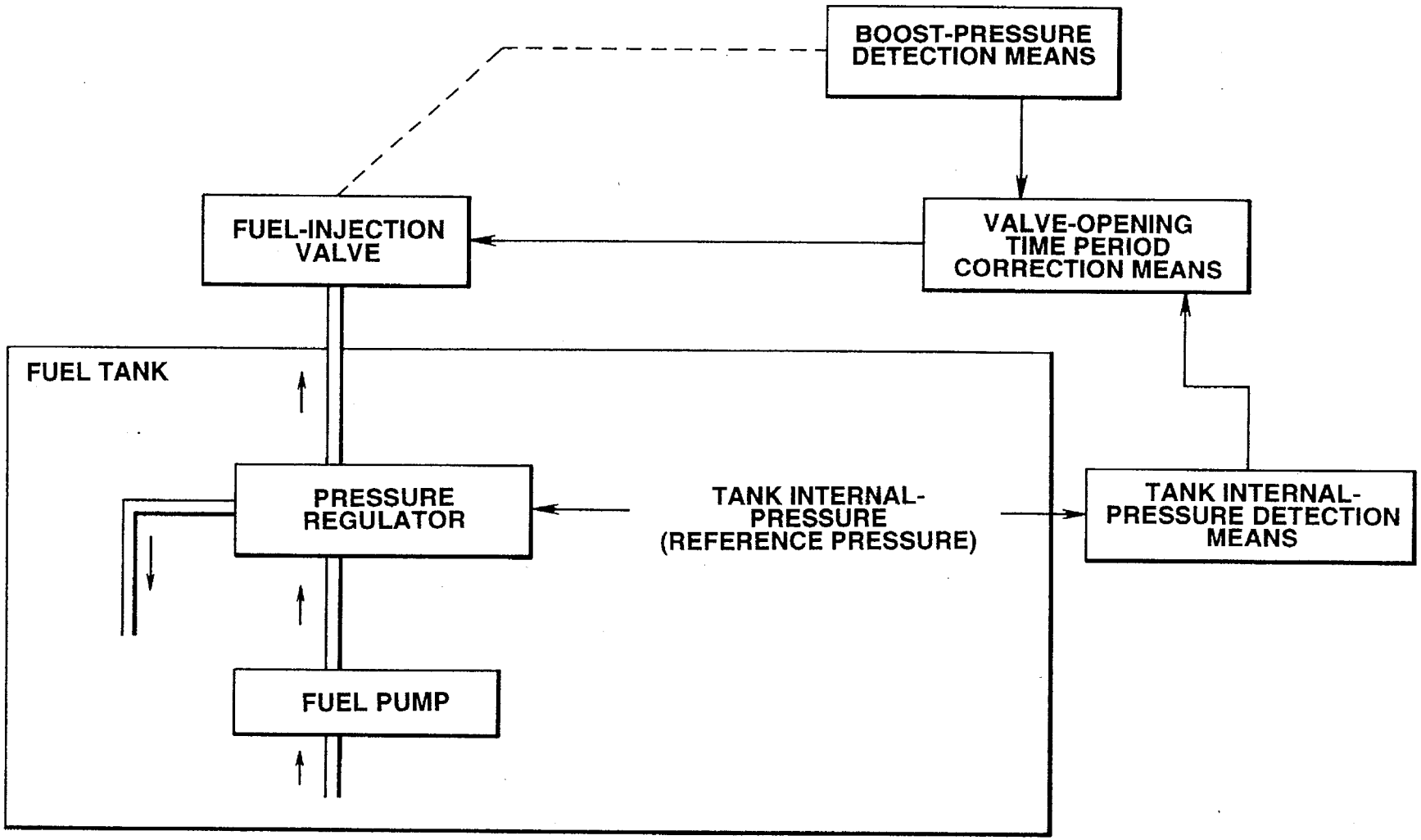
FIG. 1 is a block diagram illustrating an electronically controlled fuel-supply system for an internal combustion engine, made according to the present invention.

FIG. 1 shows essential elements of the system made according to the invention.

As seen in FIG. 1, a pressure regulator for a fuel-pressure regulation is accommodated in a fuel tank, and additionally an internal pressure in the fuel tank is used as a reference pressure necessary for the fuel-pressure regulation for pressurized fuel discharged from a fuel pump. As appreciated, there is no necessity of a long extraction conduit intercommunicating the intake manifold and the pressure regulator disposed in the tank, since a boost pressure (an intake manifold pressure) is not used as the reference pressure. That is, a long boost-pressure conduit can be eliminated. Irrespective of fluctuations in the deviation between the fuel pressure and the boost pressure, the error of the injection amount per unit valve-opening time duration, resulting from the fluctuations, can be properly compensated by correcting the target pulse width Ti of a fuel-injection pulse signal to be output to a fuel-injection valve. To properly correct the pulse width Ti, and to produce a corrected pulse width Tis, an injection-nozzle valve opening time period correction means receives both a tank internal-pressure indicative signal from a tank internal-pressure detection means and a boost pressure indicative signal from a boost-pressure detection means. For the purpose of the proper correction of the pulse width Ti essentially correlated with the nozzle valve opening time period and of a satisfactory fuel supply, the valve opening time period correction means derives a correction factor $\Delta P$ as a square root $(P_T-P_B)^{1/2}$ of the deviation between the tank internal-pressure $P_T$ and the boost pressure $P_B$, and consequently derives the corrected pulse width Tis represented by $K_T \times Ti/\Delta P$, where $K_T$ denotes a constant.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An electronically controlled fuel-supply system for an internal combustion engine, comprising:

a fuel tank;

a fuel pump mounted in said fuel tank;

a fuel-injection valve delivering fuel of a fuel-supply amount, which amount is based on its valve opening time period, to an engine cylinder;

a pressure regulator mounted in said fuel tank and responsive to a first pressure difference between a fuel pressure of fuel pumped by said fuel pump and a reference pressure, for regulating said first pressure difference at a predetermined value by opening and closing a fuel return line connected to said pressure regulator, and for delivering fuel of a fuel pressure regulated by said pressure regulator to said fuel-injection valve;

a first sensor for detecting an internal pressure in said fuel tank;

a second sensor for detecting a pressure acting on an open end of a nozzle of said fuel-injection valve;

said pressure regulator receiving said internal pressure as said reference pressure; and correction means for correcting said valve opening time period in accordance with a second pressure difference between said internal pressure in said fuel tank and said pressure acting on the open end of the nozzle.

2. An electronically controlled fuel-supply system for an internal combustion engine, comprising:

a sealed fuel tank;

a fuel pump mounted in said sealed fuel tank;

a fuel-injection valve delivering fuel of a fuel-supply amount, which amount is based on its valve opening time period, to an engine cylinder;

a pressure regulator mounted in said fuel tank and responsive to a first pressure difference between a fuel pressure of fuel pumped by said fuel pump and a reference pressure, for regulating said first pressure difference at a predetermined value by opening and closing a fuel return line, and for delivering fuel of a fuel pressure regulated by said pressure regulator to said fuel-injection valve;

a first sensor for detecting an internal pressure in said sealed fuel tank;

a second sensor for detecting an intake manifold pressure acting on an open end of a nozzle of said fuel-injection valve;

said pressure regulator having a regulated fuel-pressure chamber fluidly connected to both said fuel-injection valve and said fuel return line for regulating pressurized fuel pumped from said fuel pump by returning said pressurized fuel to said sealed fuel tank when said first pressure difference is above a predetermined value, and a reference pressure chamber receiving said internal pressure in said sealed fuel tank as said reference pressure; and correction means for correcting said valve opening time period in accordance with a second pressure difference between said internal pressure in said fuel tank and said intake manifold pressure acting on the open end of the nozzle.

3. The electronically controlled fuel-supply system as set forth in claim 2, wherein a flow rate of fuel injected from the nozzle of said fuel-injection valve is essentially proportional to a square root of a third pressure difference between said fuel pressure regulated by said pressure regulator and said intake manifold pressure acting on the open end of the nozzle, and said correction means determines a square root of said second pressure difference as a correction factor for said valve opening time period.

4. The electronically controlled fuel-supply system as set forth in claim 2, wherein an extraction port of said internal pressure in said sealed fuel tank is common to said reference pressure chamber of said pressure regulator and said first sensor.

5. The electronically controlled fuel-supply system as set forth in claim 2, wherein said second sensor comprises a boost pressure sensor measuring said intake manifold pressure.

6. The electronically controlled fuel-supply system as set forth in claim 2, wherein said second sensor comprises means for estimating said intake manifold pressure as a function of an engine load.

7. An electronically controlled fuel-supply system for an internal combustion engine, comprising:

a sealed fuel tank;

a fuel pump mounted in said sealed fuel tank;

a fuel-injection valve delivering fuel of a fuel-supply amount, which amount is based on a final pulse width of a fuel-injection pulse signal output to said fuel injection valve, to an engine cylinder;

a pressure regulator mounted in said sealed fuel tank and responsive to a first pressure difference between a fuel pressure of fuel pumped by said fuel pump and a reference pressure, for regulating said first pressure difference at a predetermined value by opening and closing a fuel return line, and for delivering fuel of a fuel pressure regulated by said pressure regulator to said fuel-injection valve;

a first sensor for detecting an internal pressure in said sealed fuel tank;

a second sensor for detecting an intake manifold pressure acting on an open end of a nozzle of said fuel-injection valve;

a third sensor for detecting an intake air flow rate of the engine;

a fourth sensor for detecting an engine revolution speed;

said pressure regulator having a regulated fuel-pressure chamber fluidly connected to both said fuel-injection valve and said fuel return line for regulating pressurized fuel pumped from said fuel pump by returning said pressurized fuel to said sealed fuel tank when said first pressure difference is above a predetermined value, and a reference pressure chamber receiving said internal pressure in said sealed fuel tank as said reference pressure;

derivation means for deriving a target pulse width of the fuel-injection pulse signal to be output to said fuel-injection valve, as a function of at least said intake air flow rate from said third sensor and said engine revolution speed from said fourth sensor; and correction means for correcting said target pulse width of the fuel-injection pulse signal in accordance with a second pressure difference between said internal pressure in said sealed fuel tank and said intake manifold pressure acting on the open end of the nozzle;

said correction means including:

(a) means for reading said internal pressure from said first sensor and said intake manifold pressure from said second sensor;

(b) means for determining a square root of said second pressure difference as a correction factor for said target pulse width;

(c) means for deriving said final pulse width from an expression of $Tis \leftarrow K_T \times (Ti/\Delta P)$, where Tis denotes said final pulse width, $K_T$ denotes a constant, Ti denotes said target pulse width, and $\Delta P$ denotes said correction factor obtained by said square root of said second pressure difference; and (d) means for generating said final pulse width to said fuel-injection valve.

* * * * *